US007860219B2

(12) United States Patent
Clark et al.

(10) Patent No.: US 7,860,219 B2
(45) Date of Patent: Dec. 28, 2010

(54) CATHODE ASSEMBLY WITH INTEGRAL TABS

(75) Inventors: Scott M. Clark, Midvale, UT (US); Gregory C. Andrews, Draper, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 11 days.

(21) Appl. No.: 12/239,541

(22) Filed: Sep. 26, 2008

(65) Prior Publication Data

US 2010/0079053 A1 Apr. 1, 2010

(51) Int. Cl.
*H01J 35/30* (2006.01)

(52) U.S. Cl. ..... 378/136

(58) Field of Classification Search ..... 378/136–138, 378/119, 124, 123
See application file for complete search history.

(56) References Cited

U.S. PATENT DOCUMENTS

| | | | | |
|---|---|---|---|---|
| 1,971,812 | A * | 8/1934 | Coolidge | 378/138 |
| 4,825,123 | A * | 4/1989 | Franzel et al. | 313/452 |
| 5,623,530 | A | 4/1997 | Lu et al. | |
| 6,762,540 | B2 | 7/2004 | Schaefer et al. | |

* cited by examiner

*Primary Examiner*—Irakli Kiknadze
(74) *Attorney, Agent, or Firm*—Workman Nydegger

(57) ABSTRACT

A cathode shield can comprise a shield body, a pair of tabs for defining a focal spot length, and a lip for concentrically aligning the cathode shield relative to a mounting element and/or an electron source of a cathode assembly. The tabs may be integral with the shield body and spaced a distance apart from each other. The distance may at least partially define the focal spot length of the electron source associated with the cathode assembly. The lip may also be integral with the shield body and extend from the shield body around at least a portion of a perimeter of the shield body so as to define a recess that is configured to receive the mounting element of the cathode assembly.

20 Claims, 9 Drawing Sheets

CATHODE ASSEMBLY WITH INTEGRAL TABS

BACKGROUND OF THE INVENTION

1. The Field of the Invention

The present invention relates generally to x-ray tubes. More particularly, the present invention relates to cathode assemblies.

2. Related Technology

The x-ray tube has become essential in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes a vacuum enclosure, a cathode assembly, and an anode assembly. The vacuum enclosure may be composed of metals such as copper, glass, ceramic, or a combination thereof, and is typically disposed within an outer housing. At least a portion of the outer housing may be covered with a shielding layer composed of, for example, lead or a similar x-ray attenuating material for preventing the escape of x-rays produced within the vacuum enclosure. In addition, a cooling medium, such as a dielectric oil or similar coolant, can be disposed in the volume existing between the outer housing and the vacuum enclosure in order to dissipate heat from the surface of the vacuum enclosure.

The cathode assembly of the x-ray tube generally consists of a metallic cathode head and a source of highly energized electrons. The anode assembly of the x-ray tube includes a target surface, which is generally manufactured from a refractory metal such as tungsten and is oriented to receive electrons emitted by the cathode assembly.

During operation of the x-ray tube, the cathode may be charged with a heating current that causes electrons to "boil" off the electron source by the process of thermionic emission. An electric potential can be applied between the cathode and the anode in order to accelerate electrons emitted by the electron source toward the target surface of the anode assembly. X-rays are generated when the highly accelerated electrons strike the target. Some of the x-rays that are produced by these processes ultimately exit the x-ray tube through a window and interact with a patient, a material sample, or another object.

It is generally desirable to maximize the focusing of the electron stream on the anode surface in order to produce a tightly collimated x-ray beam. It is well understood that the quality of diagnostic images additionally depends on the pattern, or focal spot, created by the emitted beam of electrons from the cathode onto the target surface of the target anode. In general, a smaller focal spot produces a more highly focused or collimated beam of x-rays, which in turn produces better quality x-ray images.

The characteristics of the focal spot may be affected by the configuration of the components of the cathode assembly. However, many cathode assemblies are configured in such a way that they impair the effectiveness with which the focal spot can be defined and/or maintained

BRIEF SUMMARY OF SOME EXAMPLE EMBODIMENTS OF THE INVENTION

According to one example embodiment, a cathode shield can comprise a shield body, a pair of tabs for defining a focal spot length, and a lip for concentrically aligning the cathode shield relative to a mounting element and/or an electron source of a cathode assembly. The tabs may be integral with the shield body and spaced a distance apart from each other. The distance may at least partially define the focal spot length of the electron source associated with the cathode assembly. The lip may also be integral with the shield body and extend from the shield body around at least a portion of a perimeter of the shield body so as to define a recess that is configured to receive the mounting element of the cathode assembly.

In another example embodiment, a cathode assembly may include a mounting element, an electron source, and a cathode shield. In this example, the electron source may include at least one electron emitter attached to the mounting element. In addition, the cathode shield may connect to the mounting element. Further, the cathode shield can include a shield body that partially encloses or covers the electron source. Furthermore, the cathode shield can include a plurality of tabs integral with the shield body and spaced a distance apart from each other that at least partially defines a focal spot length of the electron source. Further, the cathode shield can include means for positioning the cathode shield relative to a component of the cathode assembly.

In a further example embodiment, an x-ray tube can comprise a cathode assembly, an anode assembly, and a vacuum enclosure. The cathode assembly may comprise a mounting element, an electron source at least indirectly attached to the mounting element, and a cathode shield connected to the mounting element. In this example, the cathode shield may comprise a shield body partially enclosing the electron source, a plurality of tabs integral with the shield body and spaced apart from each other at a distance that at least partially defines the focal spot length of the electron source, and means for receiving the mounting element in a concentric position with respect to the cathode shield. In addition, the anode assembly can include a target with a target surface configured to receive electrons emitted from the cathode assembly to produce x-rays. Finally, the cathode assembly and anode assembly may be positioned within the vacuum enclosure.

This Summary is provided to introduce a selection of concepts in a simplified form that are further described below in the detailed description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

To further clarify the above and other aspects of the invention, a more particular description of the invention will be rendered by reference to specific embodiments thereof which are disclosed in the appended drawings. It is appreciated that these drawings disclose aspects of only some example embodiments of the invention and are therefore not to be considered limiting of its scope. Embodiments of the invention will be described and explained with additional specificity and detail through the use of the accompanying drawings in which.

DETAILED DESCRIPTION OF SOME EXAMPLE EMBODIMENTS OF THE INVENTION

The present disclosure provides methods, systems, and apparatuses for a cathode assembly with integral tabs. In particular, a cathode assembly can include a cathode shield having a shield body, tabs integral with the shield body, and means for positioning the tabs relative to other components in the cathode assembly.

Accordingly, embodiments of the present disclosure can improve the robustness, resistance to repositioning, and precision of tabs used for setting the focal spot length of a cathode assembly. For example, by integrating the tabs with the cathode shield, the tabs can be prevented from being inadvertently repositioned after installation. In particular, because the tabs are integrated with the cathode shield, the tabs cannot move relative to each other and maintenance of the focal spot length can be attained. As a result, the precision of tab installation and the corresponding focal spot length are improved.

In addition, some embodiments may facilitate efficient and quick installation of focal spot-setting tabs in a cathode assembly. For example, in at least one example embodiment, both the cathode shield and integral tabs can be quickly and efficiently installed in a single step, thereby reducing manufacturing time and costs. Moreover, in accordance with at least one embodiment, the cathode assembly with integral tabs can reduce or eliminate the need of specialized tools, such as tab-setting fixtures, for installing the tabs. Furthermore, example embodiments allow tab installation to be less dependent on the proficiency of the person installing the tabs.

Reference will now be made to FIGS. 1-8 wherein like structures will be provided with like reference designations. It is to be understood that the drawings are diagrammatic and schematic representations of various embodiments of the claimed invention, and are not to be construed as limiting the claimed invention, nor are the drawings necessarily drawn to scale.

Figure 1:
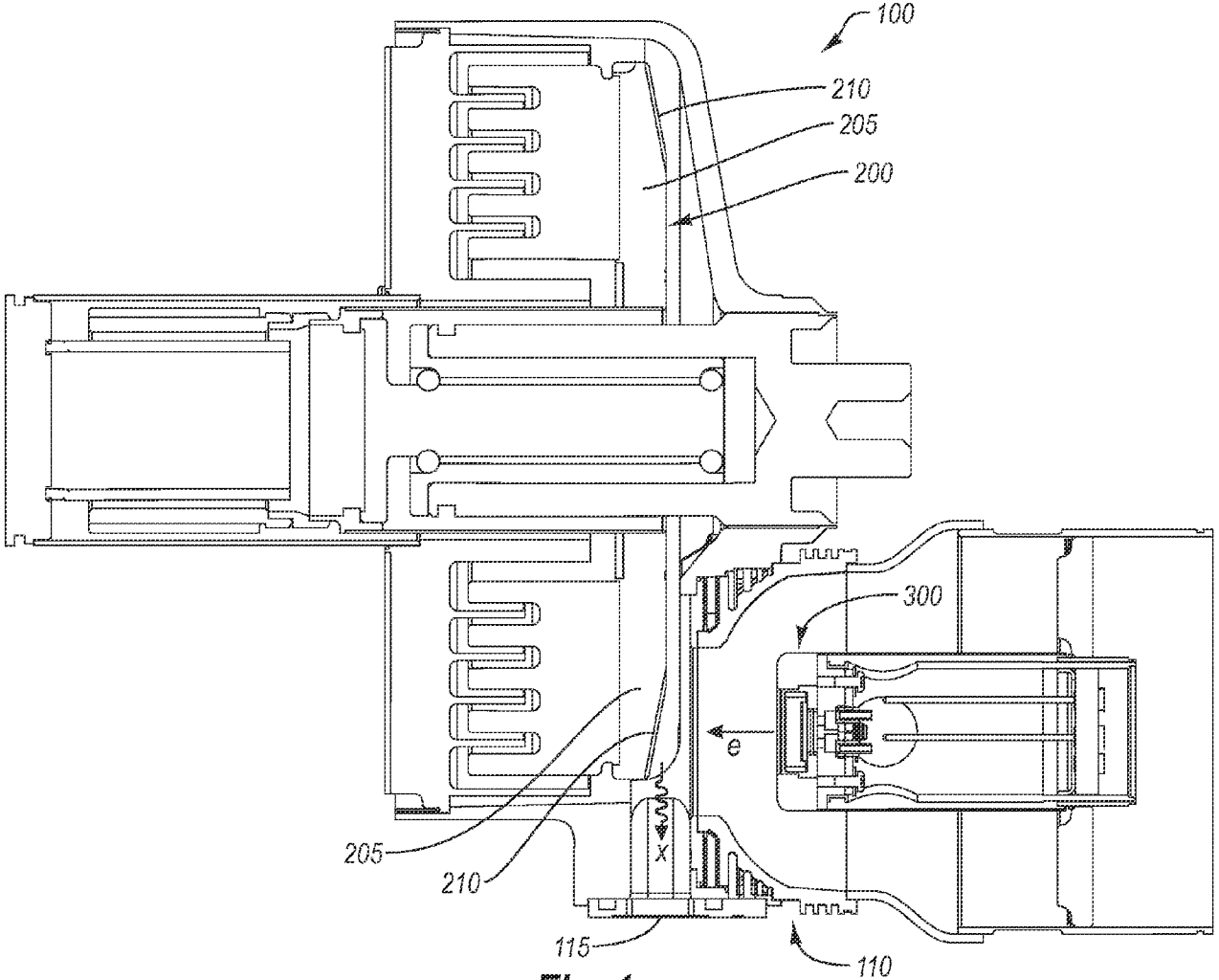
FIG. 1 discloses aspects of an example embodiment of an x-ray tube.

Reference is now made to FIG. 1, which discloses a cross-sectional view of an x-ray tube 100 in accordance with at least one example embodiment. As disclosed in FIG. 1, the example x-ray tube 100 includes a vacuum enclosure 110 within which an anode assembly 200 and a cathode assembly 300 are disposed. As further disclosed in FIG. 1, the vacuum enclosure 110 also includes a window 115 through which x-rays x can pass once produced by the anode assembly 200 and cathode assembly 300.

The vacuum enclosure 110 of the x-ray tube 100 can be manufactured using a variety of different materials. For example, in at least one embodiment, the vacuum enclosure 110 can be manufactured using any of metal, glass, ceramic, and/or other suitable materials.

The x-ray tube 100 can be implemented in a variety of different configurations. In at least one example embodiment, the x-ray tube 100 can be an anode-end grounded x-ray tube. Other examples include, but are not limited to, center-grounded, cathode-grounded, and ungrounded x-ray tubes.

In addition, the x-ray tube 100 can be included as an element of various different medical testing, medical treatment, and/or materials analysis products. For example, in one embodiment, the x-ray tube 100 can be included in a Computed Tomography (CT) scanning device which employs an x-ray source to generate a three-dimensional image of the inside of an object from a large series of two-dimensional x-ray images taken around a single axis of rotation. In further embodiments, the x-ray tube 100 can be included in other products including, but not limited to, industrial inspection devices, airport luggage scanners, x-ray crystallography devices, non-destructive testing devices, security control systems, electro-medical imaging devices, and laboratory analytical instruments. Accordingly, the scope of the invention is not limited to any particular device or application.

As further disclosed in FIG. 1, and as discussed above, the example x-ray tube 100 contains an anode assembly 200. The anode assembly 200 includes a target 205 with a target surface 210 for receiving electrons e emitted by the cathode assembly 300. The target surface 210 may comprise any number of refractory materials. For example, in one embodiment, the target surface 210 comprises tungsten. However, additional or alternative refractory materials can be used for the target surface 210.

As disclosed in the example of FIG. 1, the anode assembly 200 can comprise a rotating target 205. The target 205 rotates as the target surface 210 receives electrons e emitted by the cathode assembly 300 and to produce x-rays. Other embodiments of the invention are directed to a stationary anode configuration.

As further disclosed in the example of FIG. 1, the x-ray tube 100 includes a cathode assembly 300. In this example embodiment, the cathode assembly 300 is positioned to correspond with the position of the target 205 and target surface 210 of the anode assembly 200. As a result, electrons e emitted by the cathode assembly 300 strike the target surface 210 of the anode assembly 200 to produce x-rays x that then pass through the window 115 in the vacuum enclosure 110. The x-rays x can then be directed and/or utilized as desired for a particular application.

Figure 2:
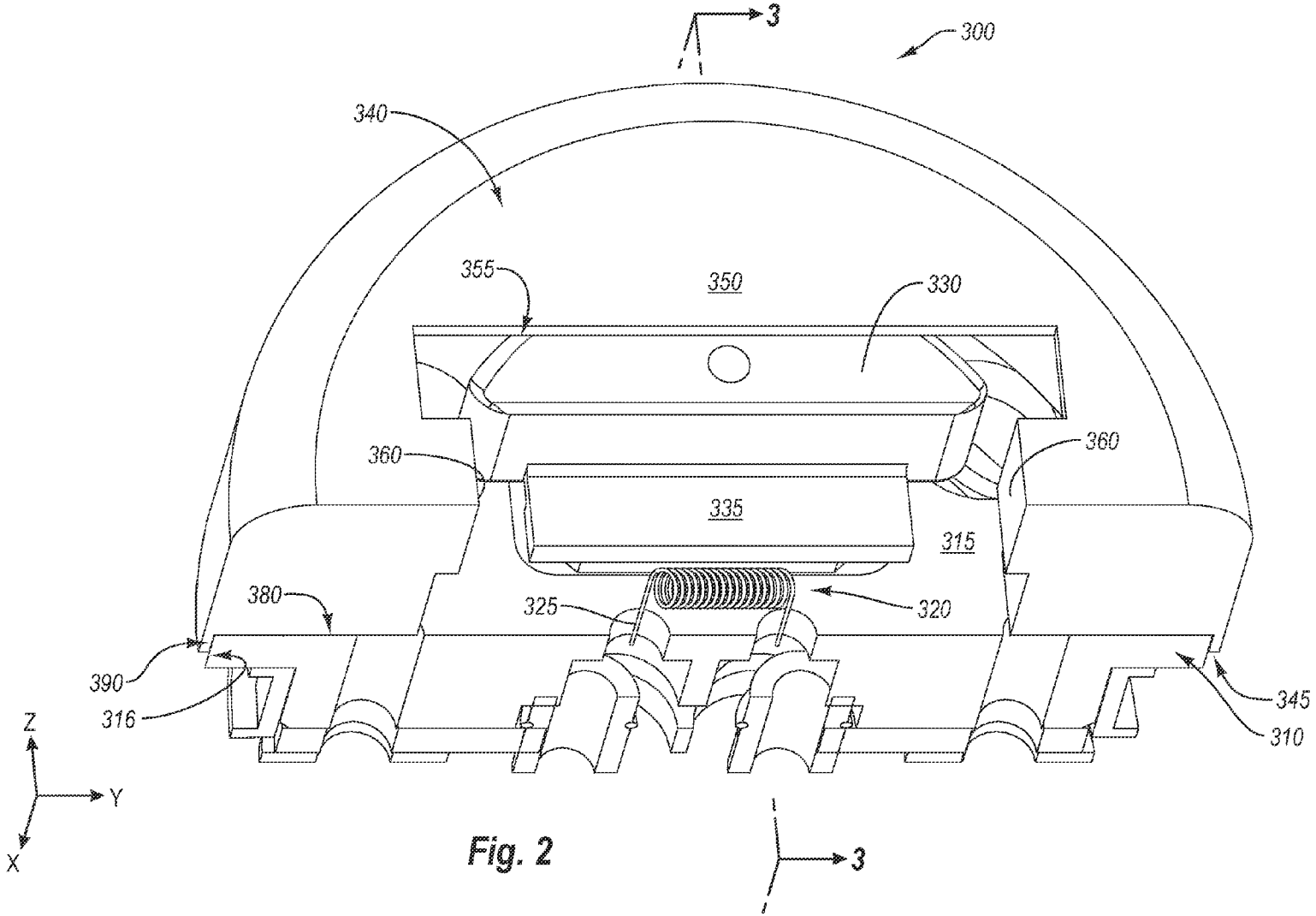
FIG. 2 is a cross-sectional view disclosing aspects of an example cathode assembly cut along a plane defined by the y and z axes.
Figure 3:
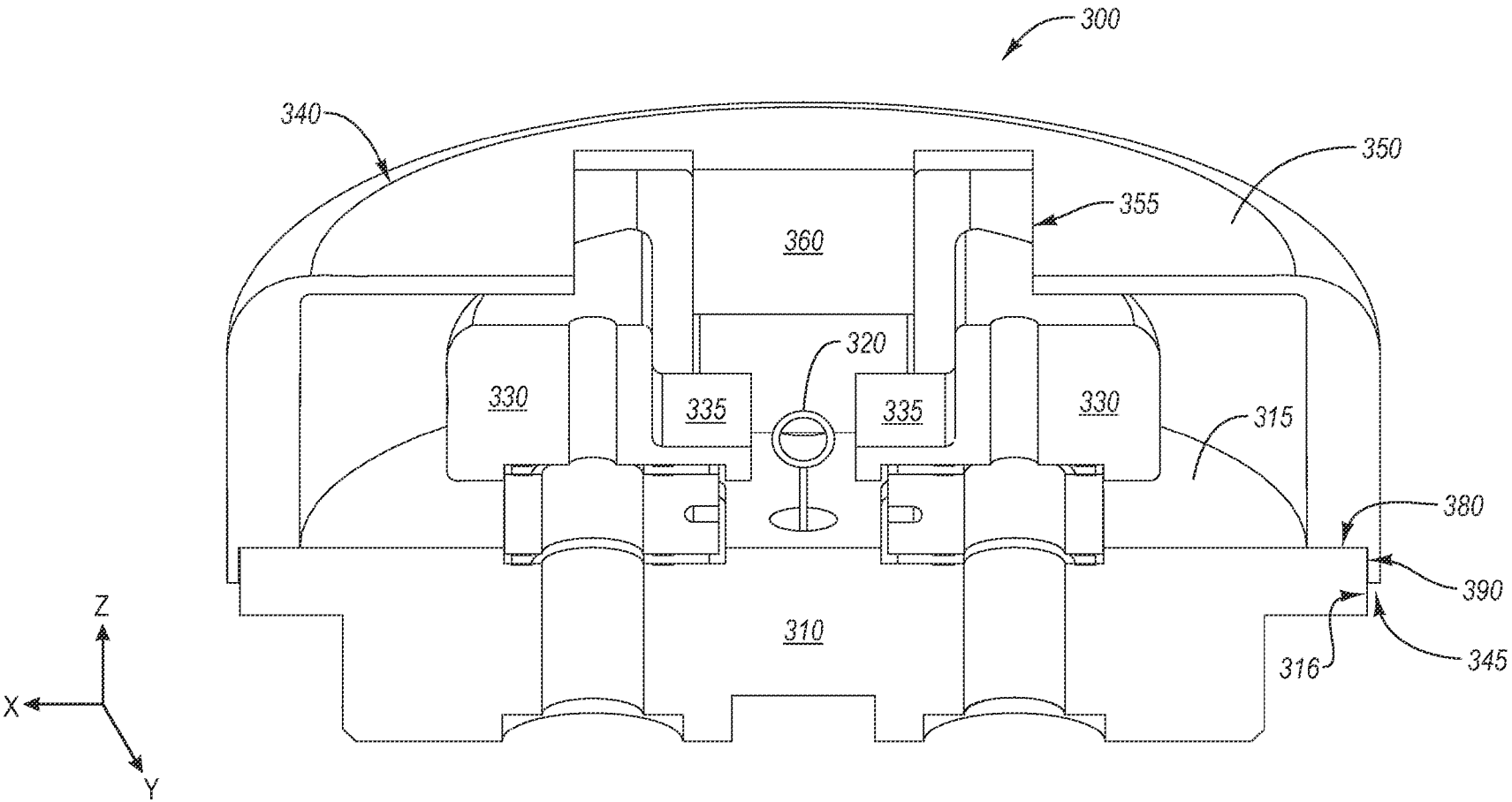
FIG. 3 is an additional cross-sectional view disclosing aspects of an example cathode assembly cut along a plane defined by the y and z axes.
Figure 4:
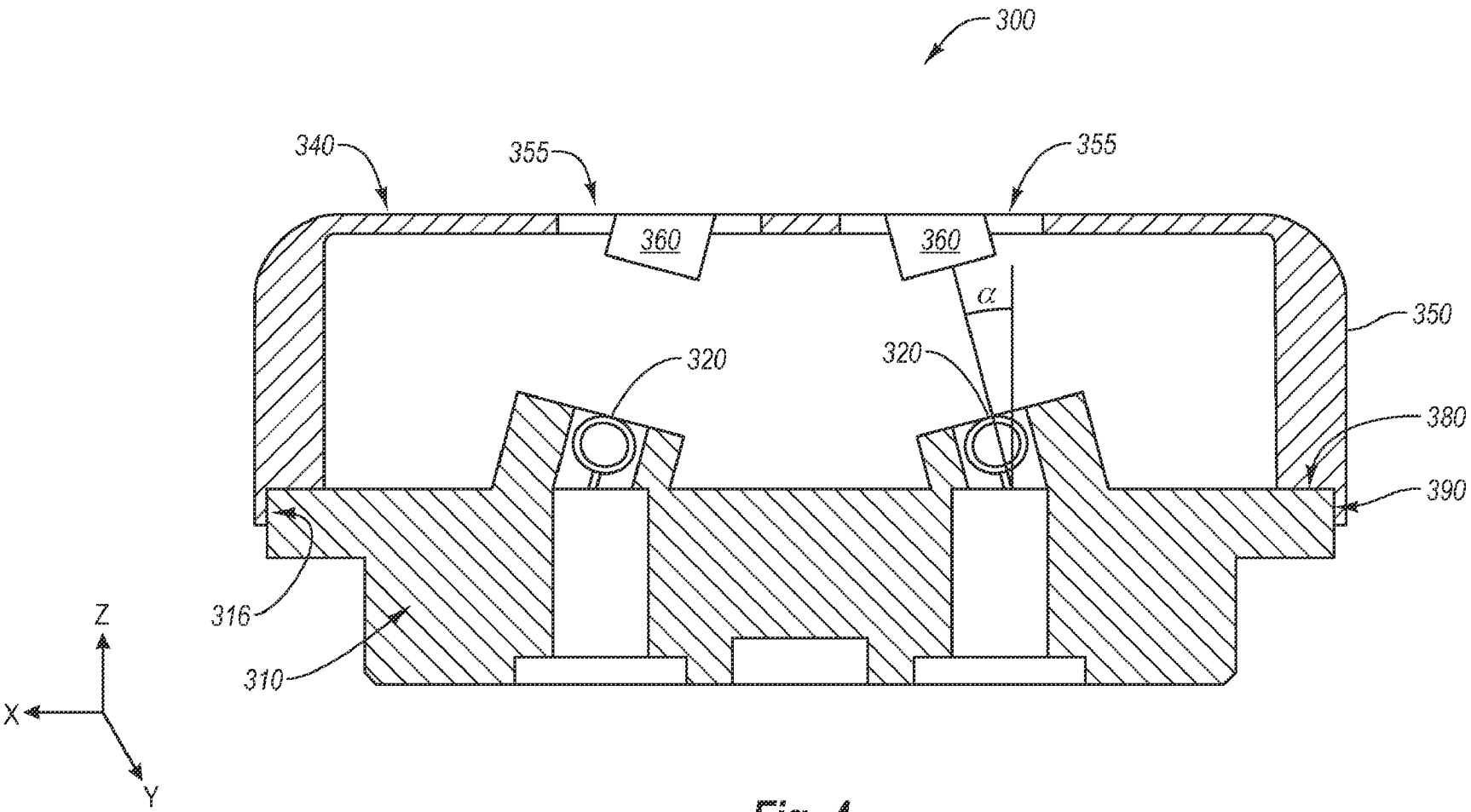
FIG. 4 is a cross-sectional view disclosing aspects of an example cathode assembly with multiple electron sources cut along a plane defined by the y and z axes.

Reference is now made to FIGS. 2-4, which disclose cross-sectional views of some example cathode assemblies 300. As shown in FIGS. 2-4, the cathode assembly 300 can include a mounting element 310, one or more electron sources 320, one or more cathode heads 330, and a cathode shield 340. The electron source(s) 320 and/or cathode head(s) 330 can be coupled to the mounting element 310 in any suitable fashion. For example, the electron source(s) 320 and cathode head(s) 330 can be attached with fasteners, clips or by glues, welding or soldering. In one example embodiment, the electron source(s) 320 is coupled to the mounting element 310 by passing one or more electrical connectors 325 through the mounting element 310 to be connected to an electrical source or electrical ground.

FIGS. 2-4 further disclose that the example cathode shield 340 partially encloses some components of the cathode assembly 300. The cathode shield 340 can also be connected, either directly or indirectly, to the mounting element 310. For example, the lower rim 345 of the cathode shield 340 can be attached, such as by welding or soldering, to the outer edge 316 of the mounting element 310.

The mounting element 310 disclosed in FIG. 2 can be manufactured using any of a number of different materials. In one example embodiment, the mounting element 310 can be manufactured using stainless steel, such as 300 series stainless steel, Vacuum Induction Remelt (VIM) stainless steel, Vacuum Arc Remelt (VAR) stainless steel, VIM/VAR stainless steel, or any other suitable material(s). Such other materials may include, but are not limited to, nickel, nickel alloys, and copper alloys. In addition, the mounting element 310 can be formed, for example, by casting, milling, and/or forging.

The shape of the mounting element 310 can correspond with the shape desired for a particular cathode assembly 300. FIGS. 2 and 3 disclose one example embodiment, in which the mounting element 310 has a substantially planar mounting surface 315 and a substantially circular shape. In further example embodiments, the mounting element 310 can be manufactured with any surface features or shapes desired. For example, the mounting element 310 can be rectangular, polygonal, elliptical, or square. In addition, the mounting element 310 can have an irregular or non-uniform mounting surface 315. In particular, the mounting element 310 can have angled or indented surfaces as desired for different configurations as shown in the example embodiment of FIG. 4.

As further disclosed in FIGS. 2-4, and as introduced above, the cathode assembly 300 can include one or more electron sources 320 for emitting electrons. The electron source(s) 320 can include any of a variety of different electron emitters. The electron emitters can be charged with a current, thereby causing electrons to be emitted by the process of thermionic emission. In one example embodiment, as disclosed in FIGS. 2-4, the electron emitter of the electron source(s) 320 can be a filament. In further embodiments, the electron emitter can be, but is not limited to, any one of flat emitters, hot emitters, cold emitters, parabolic emitters, planar or other curved emitters. The electron sources 320 in any given device may be the same as, or different from, each other. Furthermore, the physical geometry and emission characteristics of the electron sources 320 can vary from one source to another within a single device.

The electron source(s) 320 can be positioned at a variety of different launch angles $\alpha$ depending on a particular application or configuration. For example, if an electron source 320 is configured to emit electrons in a direction substantially parallel with the z-axis, the electron source 320 is referred to as having a zero launch angle $\alpha$. Examples of electron sources 320 with zero launch angles $\alpha$ are shown in FIGS. 2 and 3. In an alternative embodiment, the electron source(s) 320 may be configured to emit electrons in a direction angled away from the z-axis. Examples of electron sources 320 having non-zero launch angles $\alpha$ are shown in FIG. 4. In at least one example embodiment, the launch angles $\alpha$ of multiple electron sources 320, such as in FIG. 4, can be configured such that the individual electron beams of the electron sources 320 converge in a desired location, such as, for example, on the target surface (i.e., 210, FIG. 1) of an anode assembly (i.e., 200, FIG. 1). Furthermore, each electron source 320 may have the same, or different, respective launch angles $\alpha$.

In embodiments including multiple electron sources 320, the focal spot dimensions of each electron source 320 can be substantially the same or can vary from one electron source 320 to another as desired. For example, dimensions such as the focal spot length of the multiple electron sources 320 can differ from one electron source 320 to the next. Similarly, one or more of the focal spot width, launch angle $\alpha$, orientation, and position of each electron source 320 in the cathode assembly 300 can be individually configured as desired for a particular application.

As further disclosed in FIGS. 2 and 3, the example cathode assembly 300 can include one or more cathode heads 330. Each cathode head 330 can be mounted to the mounting element 310 and positioned proximate the electron source(s) 320. Although FIGS. 2 and 3 disclose the cathode head(s) 330 being separately mounted to the mounting element 310, in an alternative embodiment, the cathode head(s) 330 can be integral with the mounting element 310.

The cathode head(s) 330 can assist in defining the focal spot width of the electron source(s) 320. As disclosed in FIGS. 2 and 3, each cathode head 330 includes a shelf 335 positioned along the side of the electron source 320. The shelf 335 blocks or limits electron emission and, as a result, at least partially defines the width of the focal spot associated with the electron source(s) 320. As discussed below, additional structures, whether integral with or separate from the cathode head(s) 330 can also be used to partially define the dimension of the focal spot associated with the electron source(s) 320.

In one example embodiment, the cathode head(s) 330 comprises a metal. For example, the cathode head(s) 330 can be manufactured using nickel, stainless steels, alloy steels, or combinations of these and/or other metals. In particular, the cathode head(s) 330 can be manufactured using 300 series stainless steel. Of course, in embodiments wherein the cathode head(s) 330 is integrally formed with the mounting element 310, the cathode head(s) 330 can be formed using the same materials used for the mounting element 310. In addition, the cathode head 330 can be formed by casting, milling, and/or forging.

In at least some example embodiments, the cathode head(s) 330 can be configured to control the speed or direction of electrons emitted by the electron source(s) 320. For example, the cathode head(s) 330 can be gridded. The gridded configuration of the cathode head(s) 330 may allow the cathode head(s) 330 to control the speed and direction of electrons emitted from the electron source(s) 320 through the use of electrical forces exerted on the emitted electrons.

FIGS. 2-4 also disclose the inclusion of a cathode shield 340 in the cathode assembly 300. As previously discussed, the cathode shield 340 mounts to the mounting element 310. As shown, the cathode shield 340 partially encloses other components within the cathode assembly 300. For example, the cathode shield 340 of the example cathode assembly 300 partially encloses the electron source(s) 320 within the cathode assembly 300. By at least partially enclosing the electron source(s) 320, the cathode shield 340 can protect the electron source(s) 320 and other components from damage caused by, for example, physical contact with an external object. In a further embodiment, the cathode shield 340 can be a high voltage shield that protects the cathode assembly from damage caused by arcs.

As further disclosed by FIGS. 2-4, the example cathode shield 340 comprises a shield body 350 and tabs 360 integral with the shield body 350. The example shield body 350 is substantially cylindrical in shape with a circular cross-section. The shield body 350 is open along the bottom portion for receiving components of the cathode assembly 300 and mounting to the mounting element 310.

In alternative embodiments, the shield body 350 can be configured in any shape desired or necessary to correspond with different cathode assembly 300 configurations. For example, the shield body 350 can be square, rectangular, oval, spherical, triangular, or any other suitable shape. In some example embodiments, the cathode shield 340 can be sized and shaped to correspond with the size and shape of the mounting element 310. As shown in FIGS. 2-4, the substantially circular shield body 350 corresponds with the substantially circular shape of the mounting element 310. In further embodiments, the geometry of the cathode shield 340 can be varied as necessary to match up with different mounting element 310 geometries. In at least one embodiment, the shield body 350 and mounting element 310 can both be rectangular in shape. In an alternative embodiment, the shield body 350 can have a substantially planar geometry of any of a number of different shapes.

In addition, the shield body 350 also includes one or more slots 355 for passage of electrons emitted by the electron source(s) 320. The slot(s) 355 can be of any size and shape necessary to allow passage of emitted electrons. As shown in FIGS. 2-4, the example slots 355 are substantially rectangular. In alternative embodiments, the slots 355 can be oval, square, circular, or any other suitable shape.

The shield body 350 can be manufactured using a number of different materials. For example, the shield body 350 can be manufactured using a stainless steel, such as VIM/VAR, VIM, or VAR. In alternative embodiments, the shield body 350 can comprise any number of other metals, glasses, ceramics, and/or other suitable materials. In addition, the shield body 350, along with any components integral with the shield body 350, can be formed by casting, milling, and/or forging, etc.

As further disclosed in FIGS. 2-4, the example cathode shield 340 includes tabs 360 integral with the shield body 350. The tabs 360 are located at opposite ends of the slot(s) 355 and are configured for at least partially defining the focal spot length associated with the electron source(s) 320. For example, the tabs 360 are spaced a predetermined distance apart and thus facilitate control of the focal spot length of the electron source(s) 320 by limiting or blocking electron emission. The tabs 360 can comprise any structure and/or shape configured to block or limit electron emission. Furthermore, the tabs 360 can be configured to achieve any focal spot length desired for a particular application.

The tabs 360 in any given device may have the same, or different, respective geometries, locations and/or orientations. For example, the tabs 360 for one electron source 320 in a device might be different from tabs 360 for another electron source 320 in that same device. Furthermore, one electron source 320 in a device may have tabs 360 and another electron source 320 in that same device may not have tabs 360.

In the example of FIGS. 2-4, the faces of the tabs 360 are positioned proximate an end of a slot 355. In particular, in FIG. 3, the face of the integral tab 360 has a substantially rectangular cross section. In FIG. 4, the faces of the integral tabs 360 have a polygonal shape and are angled to correspond with the launch angles $\alpha$ of the electron sources 320. In alternative embodiments, the tab 310 face can have any cross-sectional shape, size, and/or orientation desired for a particular application. The tab 360 faces can be parallel to the z-axis, as shown in FIG. 2, or, in alternative embodiments, can be angled with respect to the z-axis or other axes.

As shown in FIGS. 2-4, and as suggested above, the tabs 360 are integral with the shield body 350 of the cathode shield 340. In particular, the tabs 360 are formed together with the shield body 350 such that the tabs 360 and shield body 350 comprise a single piece. As a result, the tabs 360 do not need to be installed into the cathode assembly 300 as part of a separate step, but can be installed jointly with the cathode shield 340 in a single step.

In example embodiments including multiple sets of tabs 380, such as in FIG. 4, the multiple sets of tabs 360 can be configured to correspond with the individual configurations of each particular electron source 320. In further embodiments, more than a single set of tabs 360 can be used to define the focal spot dimensions of a single electron source 320.

Because the tabs 360 are formed integrally with the shield body 350, the same materials can be used for both the tabs 360 and the shield body 350. For example, the shield body 350 and tabs 360 can be formed together using stainless steel or any other suitable material.

As disclosed in FIGS. 2-4, the example cathode shield 340 includes a ledge 380 for vertically positioning the cathode shield 340 and tabs 360 with respect to the mounting element 310 and electron source(s) 320. The ledge 380 extends from the shield body 350 and seats against the mounting element 310, thereby defining a vertical position of the tabs 360 with respect to the mounting element 310 and attached electron source(s) 320. The dimensions of the ledge 380 can vary in different configurations depending on the particular application. For example, as shown in FIGS. 2 and 3, the ledge 380 has a width that varies as it extends around the shield body 350. Specifically, the width of the ledge 380 proximate the tabs 360, as shown in FIG. 2, is greater than the width of the ledge 380 along the remaining circumference of the shield body 350, as shown in FIG. 3.

In one alternative embodiment, the ledge 380 need not extend around the entire circumference of the shield body 350, but can comprise one or more smaller portions extending intermittently from the shield body 350. In addition, the vertical position of the ledge 380 can be selectively configured in each particular application to achieve the desired height of the tabs 360 relative to the electron source(s) 320. Furthermore, the ledge 380 does not have to be limited to the shape disclosed in FIGS. 2-4, but can include any suitable shape for vertically positioning the cathode shield 340.

The example cathode shield 340 disclosed in FIGS. 2-4 also includes a lip 390 for concentrically aligning the cathode shield 340 with the mounting element 310 and electron source(s) 320. As shown, the example lip 390 is a thin rectangular band that protrudes downward beyond the ledge 380. In the example cathode shield 340, the lip 390 extends around the full circumference of the shield body 350 and defines a circular recess to receive the mounting element 310. As a result, when the mounting element 310 is received within the circular recess defined by the lip 390 and ledge 380, the mounting element 310 becomes concentrically aligned with the cathode shield 340. In further embodiments, the lip 390 need not continuously extend around the circumference of the cathode shield 340, rather the cathode shield 340 can include one or more smaller segments located intermittently around the circumference of the shield body 350. In addition, the lip 390 can incorporate any suitable shape for concentrically positioning the cathode shield 340 with respect to the mounting element 310.

Accordingly, the ledge 380 and lip 390 function to vertically and concentrically align the cathode shield with the mounting element, so as to properly position the electron source(s) 320 with respect to the tabs 360. By concentrically and vertically aligning the cathode shield 340 with the tabs 360, the electron source(s) 320 can be centered between the tabs 360 with the tabs 360 positioned at a desired height relative to the electron source(s) 320.

The ledge 380 and lip 390, as shown in FIGS. 2-4, are examples of means for positioning the cathode shield 340 with respect to other components in the cathode assembly 300, such as the electron source(s) 320. However, the means for positioning the cathode shield 340 are not limited to the ledge 380 and the lip 390. Rather, various other structures can be employed to implement the functionality of the means for positioning the cathode shield 340 and integral tabs 360.

Figure 5:
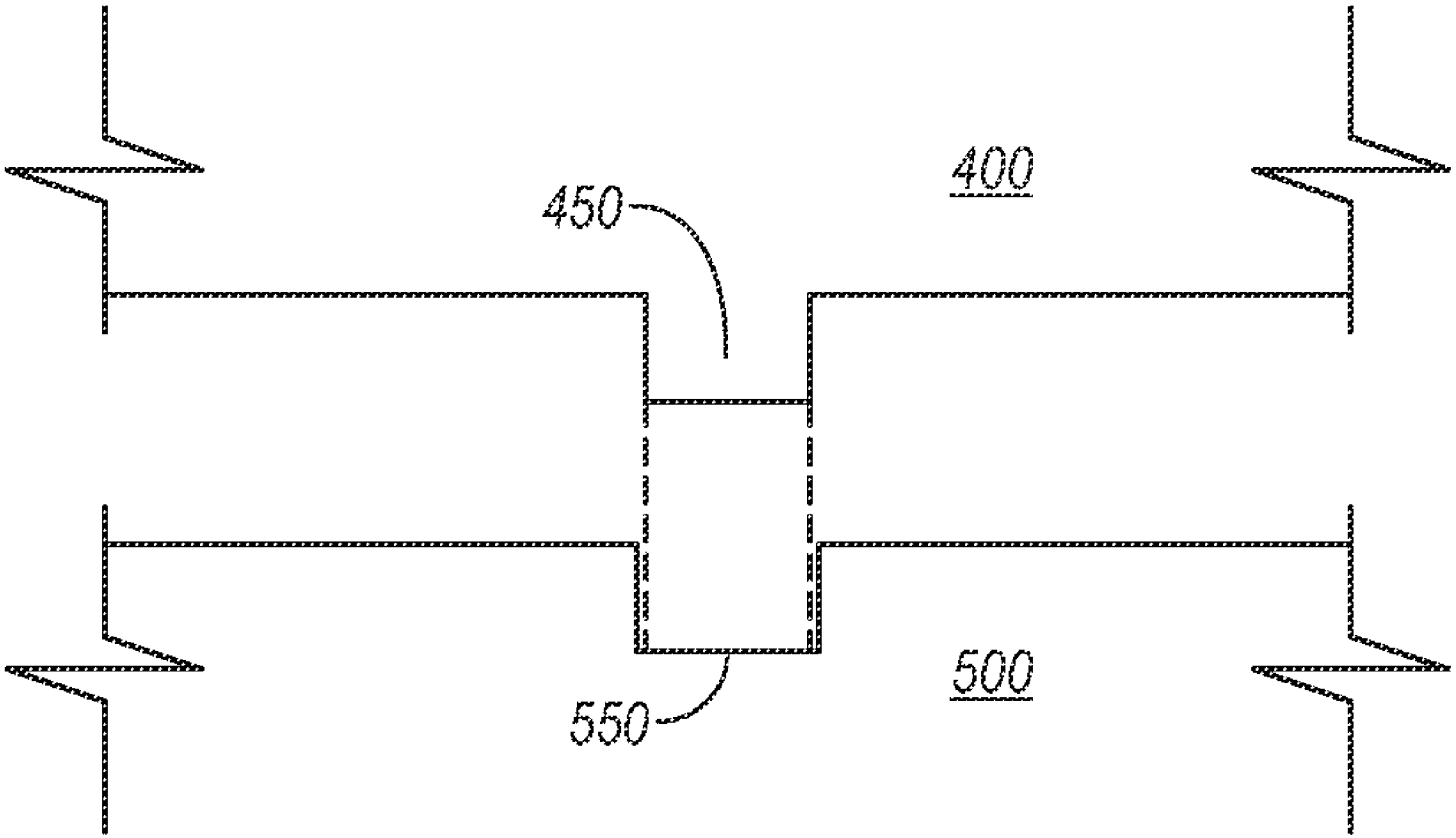
FIG. 5 is a cross-sectional view disclosing aspects of a first cathode assembly component configured to interface with a second cathode assembly component.

For example, FIG. 5 discloses aspects of example complementary structures 450, 550 included in cathode assembly components 400, 500 for positioning and/or alignment purposes. Specifically, FIG. 5 illustrates a cross-sectional view of portions of a first cathode assembly component 400 and a second cathode assembly component 500. In some embodiments, the first component 400 and second component 500 can represent any components within a cathode assembly, such as mounting elements, cathode shields, cathode heads, or any other component to be included in a cathode assembly.

As shown in FIG. 5, the first component 400 includes a first complementary structure 450 extending from its surface. The second component 500 includes a second complementary structure 550 for receiving the first complementary structure 450. The first complementary structure 450 and second complementary structure 550 can be located to align the first component 400 with the second component 500 when the first complementary structure 450 is received by the second complementary structure 550.

In one example embodiment, the first complementary structure 450 represents a ridge in the surface of the first component 400 and the second complementary structure 550 represents a groove cut into the second component 500 for receiving the ridge. The ridge and groove can be located so as to align the first component 400 with the second component 500 when the ridge is at least partially received into the groove.

In an alternative embodiment, the first complementary structure 450 can represent a pin extending from a surface of the first component 400 and the second complementary structure 550 can represent a hole located in a surface of the second component 500 for receiving the pin. The pin and hole can be located so as to properly align the first component 400 with the second component 500 when the pin is at least partially received into the hole.

In other embodiments, the first complementary structure 450 and second complementary structure 550 can represent any number of suitable complementary structures for aligning the first component 400 with the second component 500. In alternative embodiments, the first component 400 can include a plurality of first complementary structures 450 and the second component can include a plurality of second complementary structures 550 so as to position and/or align the first component 400 with respect to the second component 500.

In any event, referring again to the example embodiments disclosed in FIGS. 2-4, the cathode shield 340 with integral tabs 360 can be installed in a single step that simultaneously aligns the cathode shield 340 and tabs 360 vertically, concentrically, laterally and/or radially with respect to the mounting element 310, electron source 320, or other components.

Figure 6A:
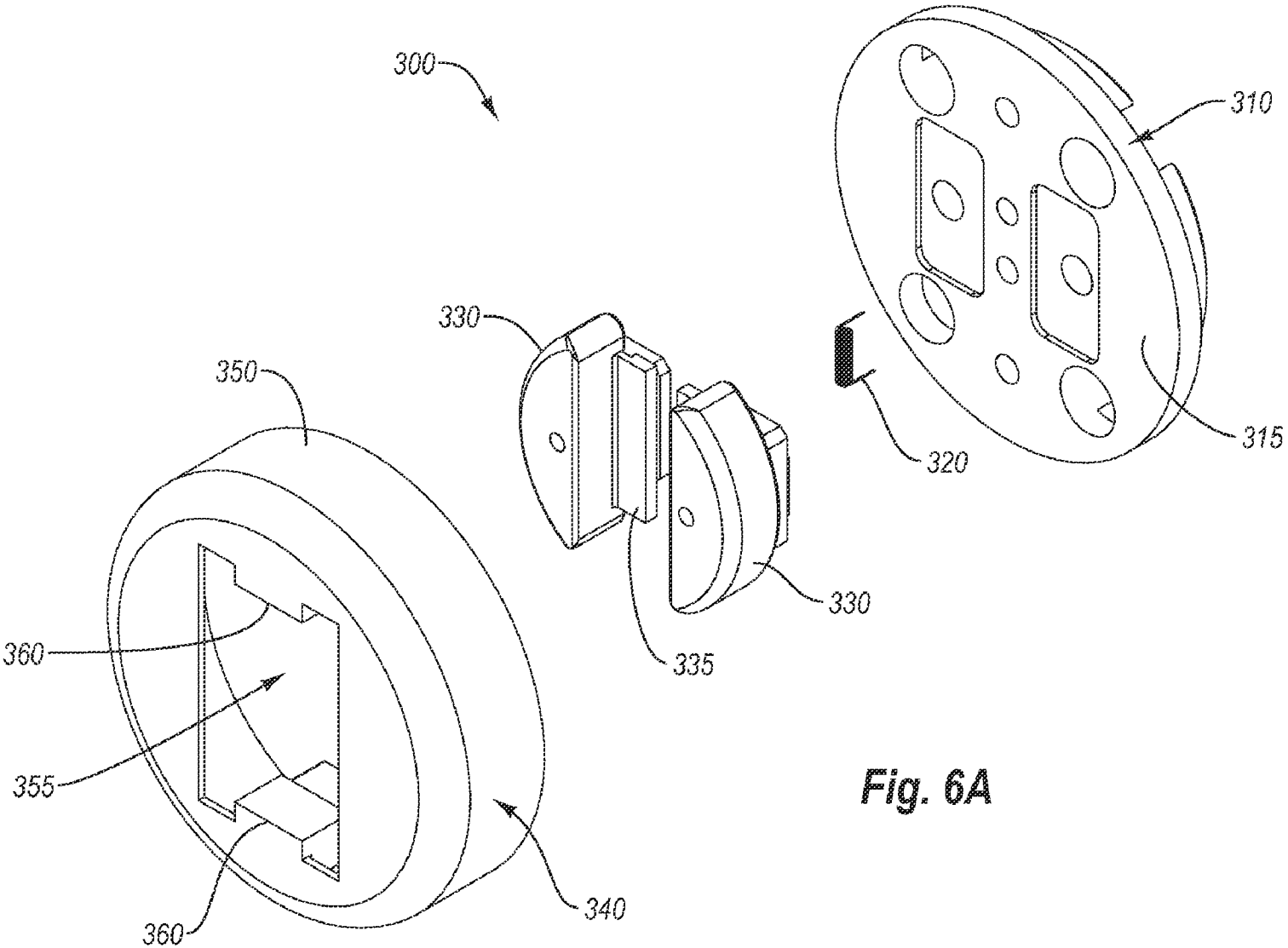
FIG. 6A is an exploded front perspective view disclosing aspects of an example cathode assembly.
Figure 6B:
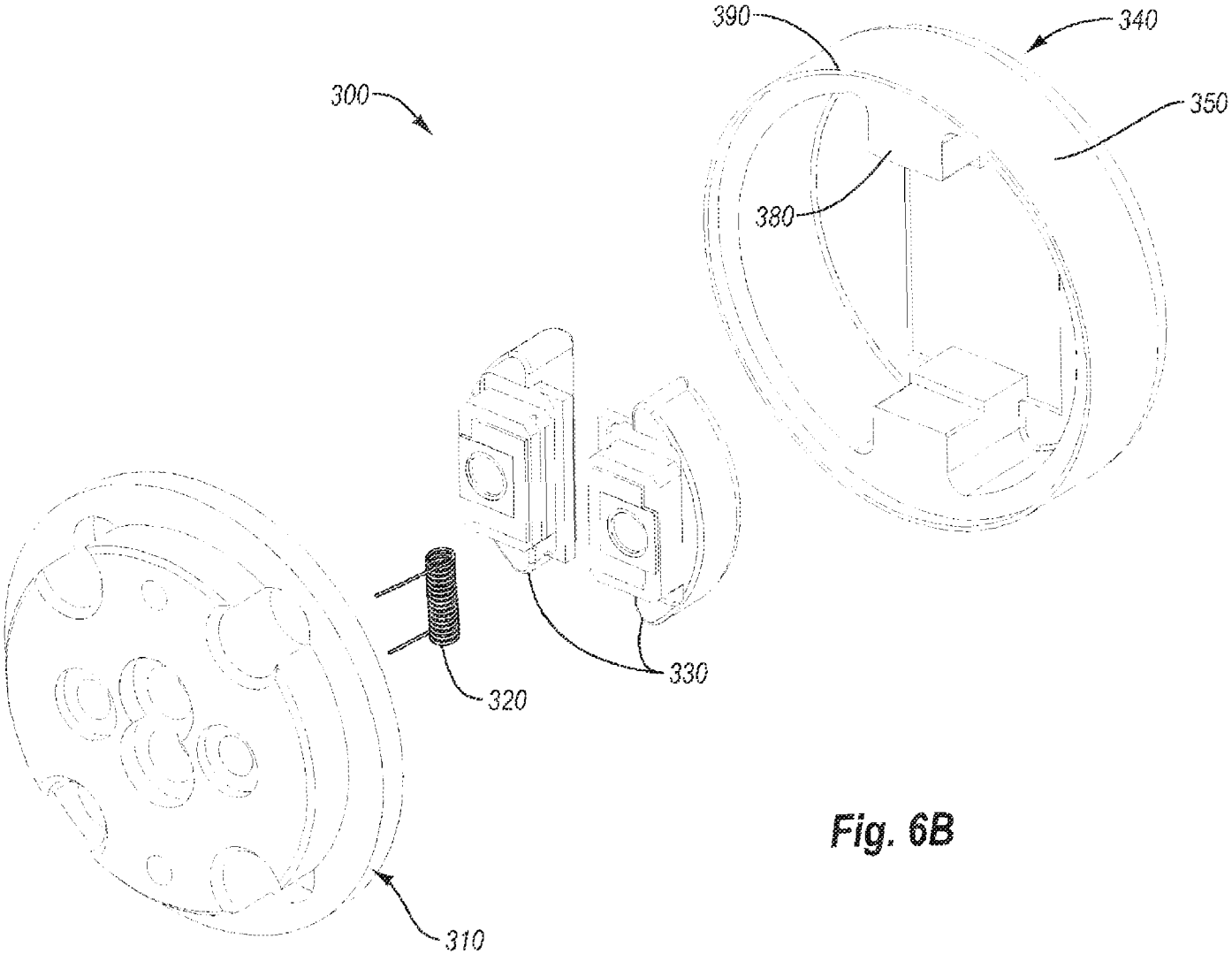
FIG. 6B is an exploded rear perspective view disclosing aspects of an example cathode assembly.

Reference is now made to FIGS. 6A and 6B, which disclose exploded views of an example cathode assembly 300. In particular, FIGS. 6A and 6B illustrate one example of how the different components of the cathode assembly 300 are combined to form the cathode assembly 300. In particular, the example cathode assembly 300 of FIGS. 6A and 6B includes a mounting element 310 to which the electron source 320 can be attached. In addition, the cathode heads 330 mount on either or both sides of the electron source 320. Finally, the cathode shield 340 mounts to the mounting element 310 to partially enclose the cathode heads 330, electron source 320, and mounting element 310.

Once the cathode shield 340 is in place, the tabs 360 of the cathode shield 340 set the focal spot length associated with electron source 320 by limiting or blocking electron emission. In alternative embodiments, the tabs 360 can be configured differently for different applications to achieve the focal spot length desired for each particular application.

FIG. 6B, in particular, discloses an exploded rear perspective view of the example cathode assembly 300. As shown, the example cathode assembly 300 includes a cathode shield 340 with a ledge 380 and a lip 390 extending from a surface of the shield body 350. The ledge 380 and lip 390 define a recess to receive the mounting element 310 so as to properly align the cathode shield 340 and integral tabs 360 with respect to the mounting element 310, electron source 320, or other components of the cathode assembly 300. As discussed in more detail above, additional elements can be included in the cathode shield 340 for alignment/positioning purposes.

Figure 7:
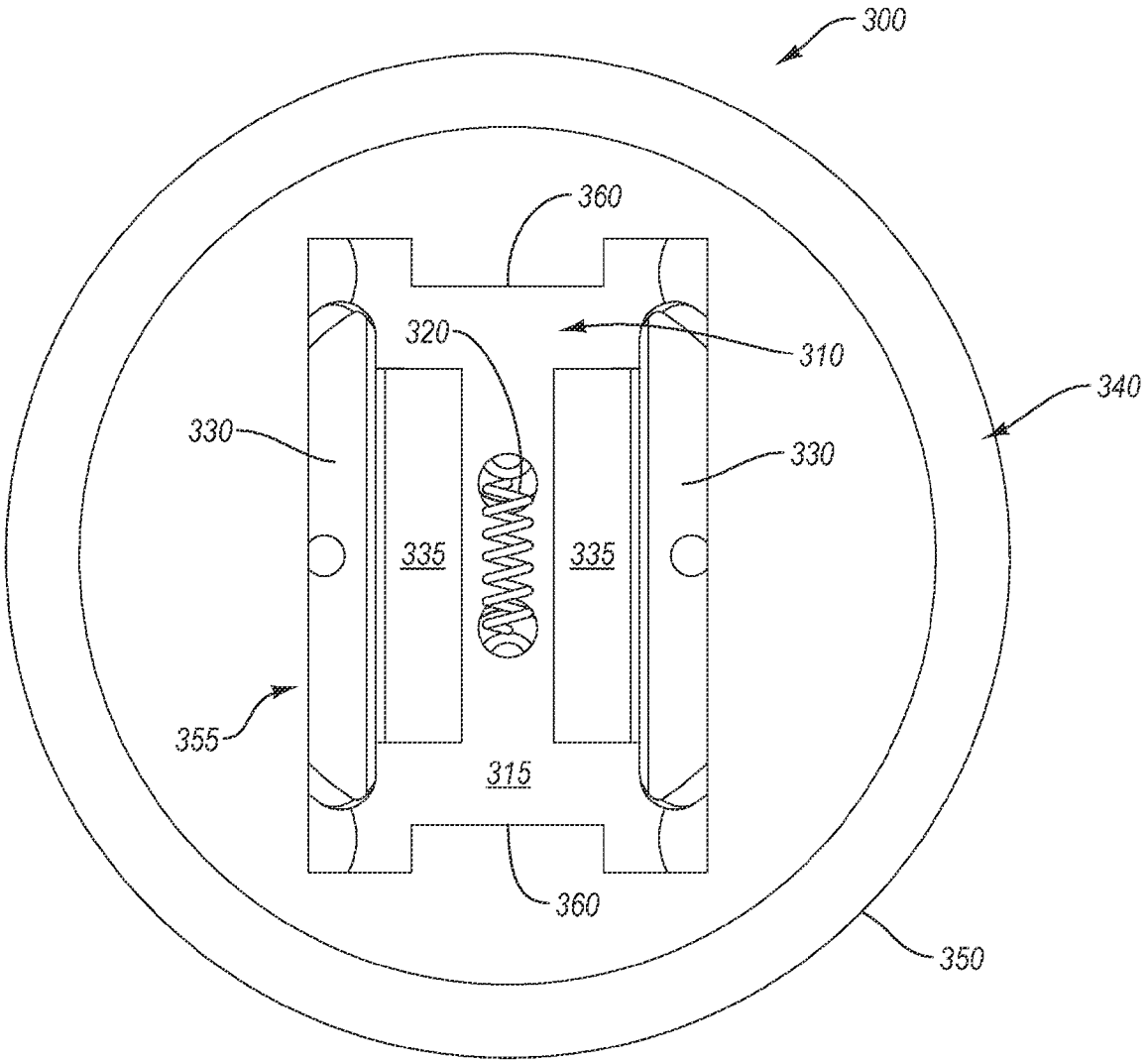
FIG. 7 is a top view disclosing aspects of an example cathode assembly.
Figure 8:
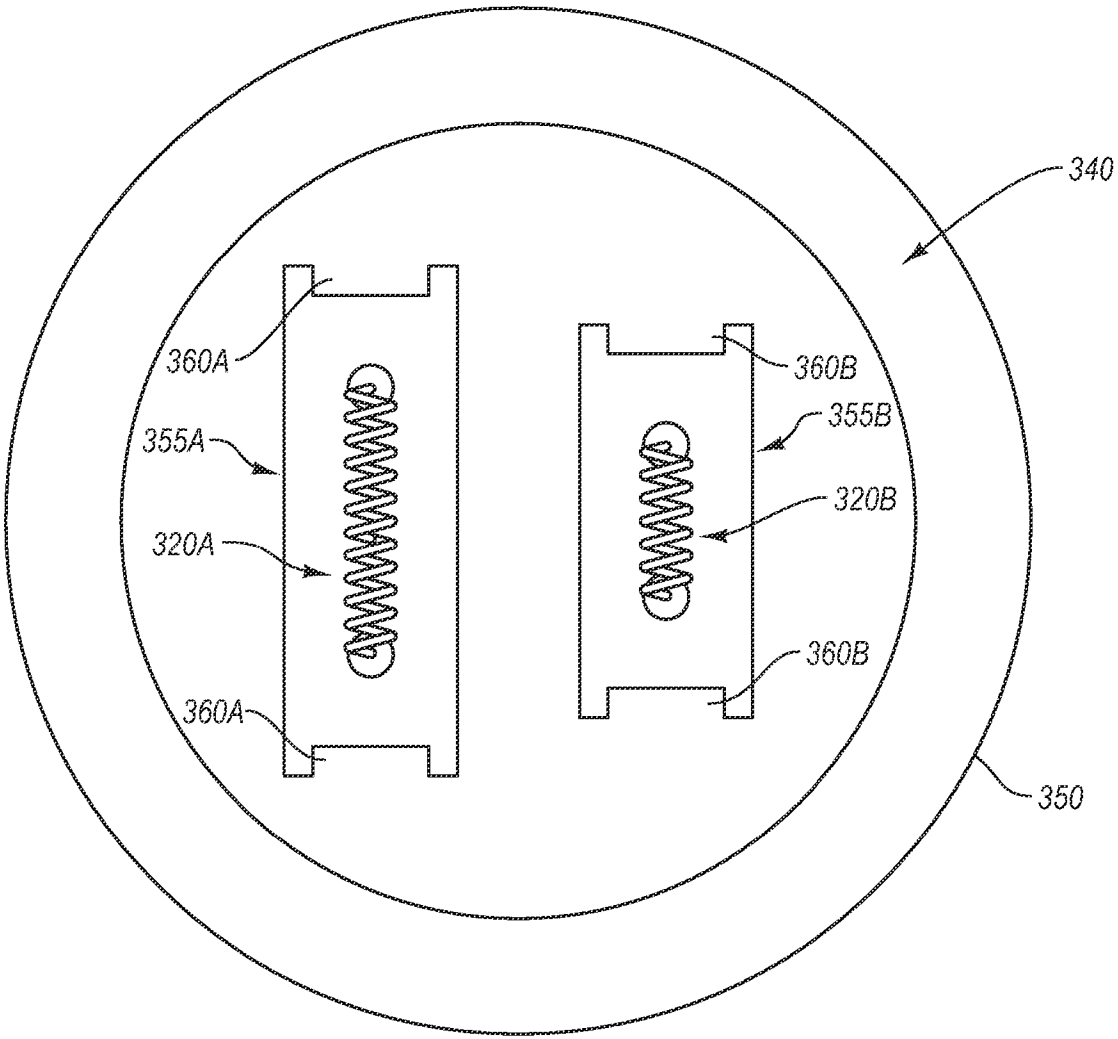
FIG. 8 is a top view disclosing aspects of an example cathode assembly having multiple electron sources.

Reference is now made to FIGS. 7 and 8 which disclose schematic top views of example cathode assemblies 300. As illustrated, the cathode assemblies 300 include one or more sets of tabs 360 integral with the shield body 350. In particular, the tabs 360 can be aligned with and positioned at the opposite ends of the slot(s) 355 in the shield body 350. As previously discussed, each slot 355 can allow electrons emitted by the electron source(s) 320 to pass through the shield body 350 and depart the cathode assembly 300. The face of the tabs 360 can extend beyond the ends of the slots 355, or can, in alternative embodiments, be flush with the ends of the slots 355. As disclosed in FIGS. 7 and 8, the cathode shield 340, integral tabs 360 and slot(s) 355 can be aligned with the electron source(s) 320 and other components of the cathode shield 300.

As further shown in FIG. 8, the example cathode assembly 300 includes multiple slots 355, multiple sets of tabs 360, and multiple electron sources 320. As disclosed, the sizes, position, and/or dimensions of multiple components, such as the slots 355, electron sources 320, and sets of tabs 360, can vary one with respect to the other within the same cathode assembly 300.

In accordance with the example embodiments described herein, tabs can be integrally included in a cathode shield and more quickly, efficiently, and precisely installed into a cathode assembly. The tabs can then set the focal spot length of an electron source by blocking or limiting electron emission. In addition, example embodiments of the present disclosure can enhance the durability of the cathode assembly by improving the robustness and resistance to repositioning of the tabs.

Additional embodiments may include other specific forms without departing from the spirit or essential characteristics of this disclosure. The described embodiments are to be considered in all respects only as illustrative and not restrictive. The scope of the described embodiments is, therefore, indicated by the appended claims rather than by the foregoing description. All changes which come within the meaning and range of equivalency of the claims are to be embraced within their scope.

What is claimed is:

1. A cathode shield comprising:

a shield body;

a first pair of tabs integral with the shield body, the first pair of tabs being spaced apart from each other at a first distance that at least partially defines a first focal spot length; and a lip integral with the shield body for concentrically aligning the cathode shield relative to a mounting element and/or an electron source of a cathode assembly, the lip extending from the shield body around at least a portion of a perimeter of the shield body so as to define a recess, the recess configured to receive the mounting element of the cathode assembly.

2. The cathode shield of claim 1, in which the shield body is substantially cylindrical in shape.

3. The cathode shield of claim 1, wherein the shield body comprises VIM/VAR stainless steel.

4. The cathode shield of claim 1, further comprising a second pair of tabs integral with the shield body, the second pair of tabs being spaced apart from each other at a second distance that at least partially defines a second focal spot length, the second distance being greater than the first distance.

5. The cathode shield of claim 1, wherein a face of each of the first pair of tabs is angled to correspond to a launch angle of the electron source.

6. A cathode assembly comprising:

a mounting element;

an electron source including at least one electron emitter attached to the mounting element; and a cathode shield connected to the mounting element, the cathode shield comprising:

a shield body partially enclosing or covering the electron source; and a plurality of tabs integral with the shield body, the tabs being spaced apart from each other at a distance that at least partially defines a focal spot length of the electron source; and means for positioning the cathode shield relative to a component of the cathode assembly.

7. The cathode assembly of claim 6, further comprising one or more additional electron sources.

8. The cathode assembly of claim 6, in which the electron emitter is a filament.

9. The cathode assembly of claim 7, in which the electron sources have different focal spot lengths with respect to one another.

10. The cathode assembly of claim 6, in which the electron source has a non-zero launch angle.

11. The cathode assembly of claim 6, further comprising a cathode head positioned between the mounting element and the cathode shield.

12. The cathode assembly of claim 11, in which the cathode head is gridded for controlling the speed and/or direction of electrons emitted from the electron source.

13. The cathode assembly of claim 6, in which the means for positioning at least partially define a vertical position of the plurality of tabs with respect to the electron source or mounting element.

14. The cathode assembly of claim 6, in which the means for positioning at least partially define a concentric position of the plurality of tabs with respect to the electron source or mounting element.

15. The cathode assembly of claim 6, in which the means for positioning at least partially define a lateral position of the plurality of tabs with respect to the electron source or mounting element.

16. An x-ray tube comprising:

a cathode assembly comprising:

a mounting element;

an electron source at least indirectly attached to the mounting element; and a cathode shield connected to the mounting element, the cathode shield comprising:

a shield body partially enclosing the electron source; and a plurality of tabs integral with the shield body, the tabs being spaced apart from each other at a distance that at least partially defines a focal spot length of the electron source; and means for receiving the mounting element in a concentric position with respect to the cathode shield;

an anode assembly including a target with a target surface configured to receive electrons emitted from the cathode assembly to produce x-rays; and a vacuum enclosure within which the cathode assembly and anode assembly are positioned.

17. The x-ray tube of claim 16, wherein the x-ray tube is an anode end-grounded x-ray tube.

18. The x-ray tube of claim 16, wherein the anode assembly is a rotating anode assembly.

19. A CT scanning device that includes the x-ray tube of claim 16.

20. The x-ray tube of claim 16, wherein the cathode shield includes a first complementary structure extending from a surface and the mounting element includes a second complementary structure for receiving the first complementary structure, the first complementary structure and second complementary structure being located so as to align and/or position the cathode shield with respect to the mounting element when the first complementary structure is received by the second complementary structure.

* * * * *